US011028855B2

(12) United States Patent
Hatanaka et al.

(10) Patent No.: US 11,028,855 B2
(45) Date of Patent: Jun. 8, 2021

(54) METHOD OF MANUFACTURING SUPERCHARGER

(71) Applicant: MITSUBISHI HEAVY INDUSTRIES ENGINE & TURBOCHARGER, LTD., Sagamihara (JP)

(72) Inventors: Masaya Hatanaka, Tokyo (JP); Makoto Takeuchi, Tokyo (JP); Kazuhiko Inoguchi, Tokyo (JP); Takashi Arai, Tokyo (JP); Hitomi Otsubo, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 0 days.

(21) Appl. No.: 15/551,660

(22) PCT Filed: Feb. 27, 2015

(86) PCT No.: PCT/JP2015/055960
§ 371 (c)(1),
(2) Date: Aug. 17, 2017

(87) PCT Pub. No.: WO2016/135973
PCT Pub. Date: Sep. 1, 2016

(65) Prior Publication Data

US 2018/0051707 A1 Feb. 22, 2018

(51) Int. Cl.
*F04D 29/22* (2006.01)
*C23C 4/02* (2006.01)
(Continued)

(52) U.S. Cl.
CPC ..... *F04D 29/2227* (2013.01); *C23C 4/02* (2013.01); *C23C 4/10* (2013.01); *F04D 13/021* (2013.01);
(Continued)

(58) Field of Classification Search
CPC ..... F01D 11/122; C08J 3/22
See application file for complete search history.

(56) References Cited

U.S. PATENT DOCUMENTS 3,046,648 A * 7/1962 Kelly ..... F16J 15/444 228/181
4,349,313 A * 9/1982 Munroe ..... F01D 11/125 415/173.4
(Continued)

FOREIGN PATENT DOCUMENTS

EP 0086938 B1 * 10/1986 ..... C23C 4/10
EP 2 570 676 A2 3/2013
(Continued)

OTHER PUBLICATIONS

"DECOTECH, Introduction to Pad Printing—Pad Printing 101, Section 3.0, <https://web.archive.org/web/20120608062434/https://www.decotechgroup.com/library/pad-printing/tech-bulletin-pad-print-101/>" (Year: 2012).*
(Continued)

*Primary Examiner* — Jacob J Cigna
*Assistant Examiner* — Michael W Hotchkiss
(74) *Attorney, Agent, or Firm* — Birch, Stewart, Kolasch & Birch, LLP

(57) ABSTRACT

An object is to provide a method of manufacturing a supercharger that can promptly and easily form an abradable layer in a supercharger. A method of manufacturing a supercharger is a method of manufacturing a supercharger including a turbine configured to rotationally drive, and a compressor having an impeller configured to rotate according to rotational force of the turbine and a housing (10) configured to store the impeller, and the method includes a process of applying coating of an abradable material which is to form an abradable layer (20) when being solidified,
(Continued)

only to a predetermined range on a surface of the housing (10) via which the impeller and the housing (10) face.

7 Claims, 9 Drawing Sheets

(51) Int. Cl.

| | |
|---|---|
| ***F04D 13/02*** | (2006.01) |
| ***F04D 29/62*** | (2006.01) |
| ***F01D 11/12*** | (2006.01) |
| ***C23C 4/10*** | (2016.01) |
| ***F04D 27/02*** | (2006.01) |

(52) U.S. Cl.
CPC ..... *F04D 27/0215* (2013.01); *F04D 29/622* (2013.01); *F01D 11/122* (2013.01); *F05D 2220/40* (2013.01)

(56) References Cited

U.S. PATENT DOCUMENTS

| | | | | |
|---|---|---|---|---|
| 4,450,184 | A * | 5/1984 | Longo | C23C 4/10 427/453 |
| 5,185,217 | A | 2/1993 | Miyamoto et al. | |
| 5,435,872 | A * | 7/1995 | Penrice | B41F 16/00 123/193.6 |
| 5,975,845 | A * | 11/1999 | Ball | F01D 11/02 415/173.4 |
| 6,652,227 | B2 * | 11/2003 | Fried | F01D 11/122 415/173.4 |
| 7,537,809 | B2 | 5/2009 | Ochiai et al. | |
| 8,209,831 | B2 * | 7/2012 | Boehm | C23C 4/02 29/90.01 |
| 8,939,706 | B1 * | 1/2015 | Lee | F01D 11/122 415/1 |
| 8,939,707 | B1 * | 1/2015 | Lee | F01D 11/122 415/1 |
| 9,534,119 | B2 * | 1/2017 | Suman | C09D 5/033 |
| 10,132,185 | B2 * | 11/2018 | Gold | F01D 25/24 |
| 10,189,082 | B2 * | 1/2019 | Tham | B28B 11/048 |
| 2003/0170119 | A1 * | 9/2003 | Fried | F01D 11/125 415/173.4 |
| 2005/0003172 | A1 * | 1/2005 | Wheeler | C23C 4/04 428/210 |
| 2006/0165524 | A1 * | 7/2006 | Pellkofer | B23P 15/00 415/206 |
| 2007/0134411 | A1 * | 6/2007 | Cont | B01J 13/02 427/213.34 |
| 2009/0232642 | A1 | 9/2009 | Anema | |
| 2012/0087781 | A1 * | 4/2012 | Metscher | F01D 11/001 415/174.4 |
| 2013/0209786 | A1 * | 8/2013 | Allen | C04B 35/468 428/319.1 |
| 2013/0280047 | A1 * | 10/2013 | Willett, Jr. | F01D 11/18 415/170.1 |
| 2014/0199163 | A1 | 7/2014 | Lee | |
| 2015/0176423 | A1 * | 6/2015 | Cortequisse | F01D 25/246 415/119 |
| 2015/0198056 | A1 * | 7/2015 | Amini | C08K 3/04 415/173.4 |
| 2015/0308276 | A1 * | 10/2015 | Kleinow | F01D 5/20 416/228 |
| 2015/0354392 | A1 * | 12/2015 | Lipkin | F01D 11/122 415/173.4 |
| 2015/0354393 | A1 * | 12/2015 | Lipkin | F01D 11/125 427/448 |
| 2015/0354397 | A1 * | 12/2015 | Novikov | C10M 109/00 277/306 |
| 2016/0138413 | A1 * | 5/2016 | Cortequisse | F01D 9/041 415/173.4 |
| 2016/0169013 | A1 * | 6/2016 | Guo | F01D 5/20 415/200 |
| 2016/0230582 | A1 * | 8/2016 | Schlothauer | F01D 11/08 |
| 2016/0312638 | A1 * | 10/2016 | Philbrick | F01D 11/122 |
| 2016/0327059 | A1 * | 11/2016 | Amini | F01D 5/28 |
| 2017/0016454 | A1 * | 1/2017 | Strock | F04D 29/324 |
| 2017/0114714 | A1 * | 4/2017 | Niwa | F04D 29/162 |
| 2017/0167279 | A1 * | 6/2017 | Kirby | F01D 11/001 |
| 2018/0087387 | A1 * | 3/2018 | Shi | F01D 5/288 |
| 2018/0347389 | A1 * | 12/2018 | Prenger | F04D 29/083 |
| 2018/0361480 | A1 * | 12/2018 | Le Biez | B22F 3/105 |

FOREIGN PATENT DOCUMENTS

| | | | | |
|---|---|---|---|---|
| EP | 2896796 | B1 * | 9/2019 | F01D 25/246 |
| JP | 3-52398 | U | 5/1991 | |
| JP | 3-68529 | U | 7/1991 | |
| JP | 3-237299 | A | 10/1991 | |
| JP | 10-507245 | A | 7/1998 | |
| JP | 2000-345984 | A | 12/2000 | |
| JP | 3639846 | B2 | 4/2005 | |
| JP | 2006-144790 | A | 6/2006 | |
| JP | 2006-150155 | A | 6/2006 | |
| JP | 2009-522430 | A | 6/2009 | |
| JP | 2010-796 | A | 1/2010 | |
| JP | 2016-98757 | A | 5/2016 | |
| WO | WO 2012/122373 | A1 | 9/2012 | |

OTHER PUBLICATIONS

Machine Translation of EP2896796B1 (Year: 2019).*
Office Action dated Jul. 31, 2018 in corresponding Japanese Patent Application No. 2017-501813 with an English Translation.
International Search Report (Form PCT/ISA/210) issued in International Application No. PCT/JP2015/055960 dated May 26, 2015, together with an English translation.
Written Opinion of the International Searching Authority (Form PCT/ISA/237) issued in International Application No. PCT/JP2015/055960 dated May 26, 2015, together with an English translation.
Extended European Search Report dated Oct. 29, 2018 for corresponding European Patent Application No. 15883267.5
Office Action dated Feb. 26, 2019 for corresponding Japanese Patent Application No. 2017-501813.
Office Action dated Jul. 15, 2019 in corresponding European Application No. 15883267.5.

* cited by examiner

METHOD OF MANUFACTURING SUPERCHARGER

TECHNICAL FIELD

The present invention relates to a method of manufacturing a supercharger including a compressor having an impeller configured to rotate according to the rotational force of a turbine to compress air.

BACKGROUND ART

In a turbocharger (supercharger), a turbine rotationally drives according to exhaust gas of an engine, and an impeller of a centrifugal compressor rotates according to the rotational force of the turbine. Compressed air compressed by the centrifugal compressor is fed into the engine.

In the centrifugal compressor of the turbocharger, on an inner surface side of a housing, a clearance gap is provided between the housing and the impeller. This can prevent contact between the housing and the impeller that is caused by the influence of heat expansion and vibration in operations, and component tolerance.

On the other hand, by narrowing the clearance gap between the housing and the impeller, the performance of the turbocharger can be enhanced. For this reason, a member that is easily abraded even if the impeller comes into contact with the member (hereinafter, also referred to as an "abradable material") is provided on a housing inner surface in some cases. The following PTL 1 discloses that an abradable coating layer made of synthetic resin is formed on an inner periphery of a housing that faces an impeller.

An abradable layer narrows a clearance gap between the housing and the impeller. The performance can be thereby enhanced while reliability is assured because the impeller is not damaged even if the impeller comes into contact with the abradable layer.

CITATION LIST

Patent Literature

{PTL 1}
Japanese Unexamined Utility Model Application, Publication No. Hei 3-52398
{PTL 2}
The Publication of Japanese Patent No. 3639846
{PTL 3}
Japanese Unexamined Patent Application, Publication No. 2010-796

SUMMARY OF INVENTION

Technical Problem

The aforementioned PTL 2 discloses a method of attaching a synthetic-resin slide member to a housing by adhesion. Nevertheless, productivity degrades because a process of manufacturing the synthetic-resin slide member and an adhesion process are additionally required, and the number of components increases. In addition, it is necessary to separately manufacture the synthetic-resin slide members according to the shape of the housing or the impeller, so that the number of types of components also increases.

The aforementioned PTL 3 discloses a method of closely adhering a molding die to the inner surface side of a housing, and injecting synthetic resin into a space between the housing and the molding die. Using this method, a slide member is formed on the inner surface side of the housing through injection molding. Nevertheless, productivity is bad because it is necessary to change the molding die according to the shape of the housing or an impeller.

Furthermore, the aforementioned PTL 1 discloses a method of forming the abradable coating layer on the inner periphery of the housing by spraying synthetic resin onto the inner periphery of the housing by means of thermal spraying. Nevertheless, in the case of thermal spraying and spray coating, it is difficult to confine an application region. In addition, it is also difficult to adjust a coating thickness. Thus, masking of regions surrounding the application region, and post-processing or finishing for adjusting a coating thickness are generally required, which degrades productivity.

The present invention has been contrived in view of such circumstances, and the object of the present invention is to provide a method of manufacturing a supercharger that can promptly and easily form an abradable layer in the supercharger.

Solution to Problem

For solving the aforementioned problems, a method of manufacturing a supercharger according to the present invention employs the following solutions.

More specifically, a method of manufacturing a supercharger according to the present invention is a method of manufacturing a supercharger including a turbine configured to rotationally drive, and a compressor having an impeller configured to rotate according to rotational force of the turbine and a housing configured to store the impeller, and the method includes a process of applying coating of an abradable material which is to form an abradable layer when being solidified, only to a predetermined range on either one of surfaces of the impeller and the housing via which the impeller and the housing face.

With this configuration, because the coating of the abradable material is applied onto the surface of the impeller or the surface of the housing, it is unnecessary to additionally manufacture an abradable material as a component, and to perform changeover according to the shape of the impeller or the housing. In addition, in the coating application, adjustment of a coating thickness is generally easy, so that the post-processing and the finishing become unnecessary.

For example, the coating of the abradable material is applied onto an inner peripheral surface of the housing (a surface facing a tip portion of a blade of the impeller, or a surface facing an outer peripheral surface on an end plate side of the impeller), the tip portion of the blade of the impeller, or the outer peripheral surface on the end plate side of the impeller.

In the aforementioned invention, coating of the abradable material is applied only to the predetermined range without applying masking.

With this configuration, because the coating of the abradable material is applied only to the predetermined range without applying masking, productivity can be enhanced. In addition, because the coating is applied without performing masking, the abradable material wetly spreads on the surface of the impeller or the housing. This consequently causes a state in which no level difference is generated at an end portion of the abradable layer, unlike a case of applying masking. Thus, the separation of airflow on the surface of the impeller or the housing can be suppressed, and efficiency degradation of the supercharger can also be suppressed.

In the aforementioned invention, coating of the abradable material is applied using a constant amount discharge nozzle, a brush, or a pad.

With this configuration, the coating of the abradable material is applied in a state in which the abradable material is brought close to the surface of the impeller or the housing, or pressed against the surface of the impeller or the housing. It is therefore easy to form the abradable layer only in the predetermined range without applying masking.

In the aforementioned invention, a process of forming a protruding portion or a recess portion on the surface of the impeller or the housing at a boundary of a region in which the abradable layer is to be formed, before the process of applying coating of the abradable material is further included.

With this configuration, by the protruding portion or the recess portion being formed on the surface of the impeller or the housing, it becomes difficult for the abradable material to spread excessively, and the abradable layer is surely applied to the predetermined range. When the protruding portion or the recess portion is formed, the protruding portion or the recess portion desirably has such a height or a depth that a flow of air is not disturbed, and preferably has such a shape that the abradable layer and the impeller or the housing are smoothly connected.

In the aforementioned invention, a process of increasing a roughness degree in an outside region of a region in which the abradable layer is to be formed, to be rougher than a roughness degree in the region in which the abradable layer is to be formed, before the process of applying coating of the abradable material is further included.

With this configuration, by the roughness degree getting higher in the outside region of the region in which the abradable layer is to be formed, it becomes difficult for the abradable material to spread excessively, and the abradable layer is surely applied to the predetermined range.

In the aforementioned invention, the abradable material contains synthetic resin and fine particles having a self-lubricating property.

With this configuration, because the slidability of the abradable layer is assured, frictional resistance caused when the impeller comes into contact therewith can be reduced, and damages to the impeller can be prevented.

In the aforementioned invention, coating of the abradable material is applied so that a density becomes lower on a surface side of the abradable layer than a density on a side of the impeller or a side of the housing, when the abradable material is solidified.

With this configuration, because strength becomes lower on the surface side of the abradable layer, the abradable material becomes easily-abradable when the impeller comes into contact therewith, and damages to the impeller can be prevented.

Advantageous Effects of Invention

According to the present invention, an abradable layer can be promptly and easily formed in a supercharger.

DESCRIPTION OF EMBODIMENTS

First Embodiment

Figure 1:
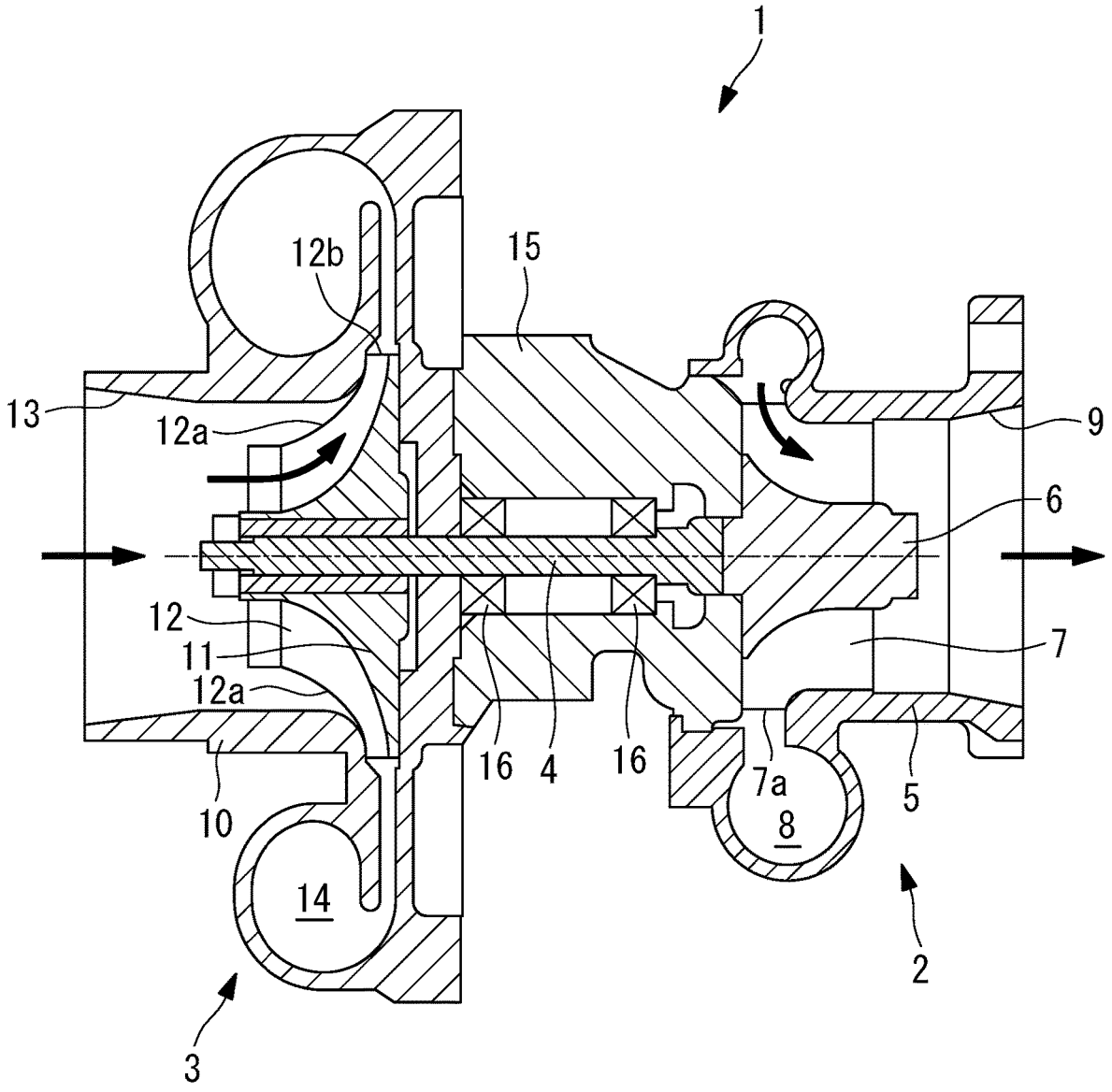
FIG. 1 is a vertical cross-sectional view illustrating a supercharger according to a first embodiment of the present invention.

A turbocharger (supercharger) according to a first embodiment of the present invention will be described below using FIG. 1.

A turbocharger 1 includes a turbine 2, a compressor 3, and a rotation shaft 4 coupled to the turbine 2 and the compressor 3. The turbine 2 rotationally drives according to exhaust gas from an engine, and an impeller 11 of the compressor 3 rotates according to the rotational force of the turbine 2. Air compressed by the compressor 3 is supplied to the engine.

The turbine 2 is disposed on one end side of the rotation shaft 4, and includes an impeller 6, a housing 5, and the like.

The impeller 6 includes a blade 7, and is coupled to the rotation shaft 4 to rotate around a shaft line.

The housing 5 covers the impeller 6 from the outside, and a scroll passage 8 communicating the inside and the outside of the housing 5 is formed therein. The scroll passage 8 extends from an end portion (a leading edge portion 7*a*) on the outside in a radial direction of the blade 7, outward in the radial direction, and is formed into a ring shape around the shaft line of the rotation shaft 4. The exhaust gas is introduced into the impeller 6 from the scroll passage 8 to rotate the impeller 6 and the rotation shaft 4.

A discharge port 9 opening on one end side of the shaft line of the rotation shaft 4 is formed in the housing 5. Exhaust gas having passed through the blade 7 is discharged to the outside of the housing 5 through the discharge port 9.

The compressor 3 is a centrifugal compressor, for example, and is disposed on the other end side of the rotation shaft 4, and includes the impeller 11, a housing 10, and the like.

The impeller 11 includes a blade 12, and is coupled to the rotation shaft 4 to rotate around the shaft line.

The housing 10 covers the impeller 11 from the outside. A suction port 13 opening on the other end side of the shaft line of the rotation shaft 4 is formed in the housing 10. Air is introduced into the impeller 11 from the outside through the suction port 13. The rotational force of the impeller 6 of the turbine 2 is transmitted to the impeller 11 via the rotation shaft 4, so that the impeller 11 rotates. Air introduced from the outside is compressed by passing through the impeller 11.

A compressor passage 14 communicating the inside and the outside of the housing 10 is formed in the housing 10, and the compressor passage 14 extends from an end portion (a trailing edge portion 12*b*) on the outside in a radial direction of the blade 12, outward in the radial direction, and is formed into a ring shape around the shaft line of the rotation shaft 4. Air compressed in the impeller 11 is introduced into the compressor passage 14 and is discharged to the outside of the housing 10.

A bearing housing 15 is disposed between the turbine 2 and the compressor 3 to couple the turbine 2 and the compressor 3. The bearing housing 15 covers the rotation shaft 4 from the outside. A bearing 16 is provided in the bearing housing 15, and the bearing 16 supports the rotation shaft 4 so as to be rotatable with respect to the bearing housing 15.

In addition, depending on the configuration of the turbocharger 1, in some cases, the bearing housing 15 is disposed so that an inner peripheral surface of the bearing housing 15 faces the impeller 11.

Figure 2:
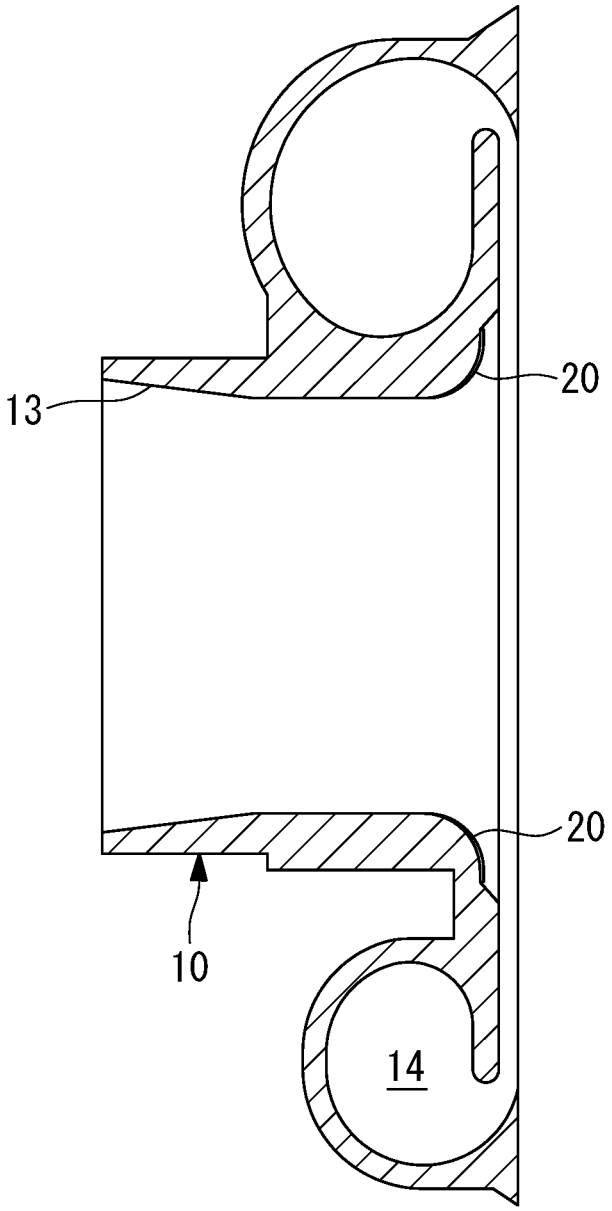
FIG. 2 is a vertical cross-sectional view illustrating a housing of a compressor of the supercharger according to the first embodiment of the present invention.

An abradable layer 20 (refer to FIG. 2) is formed in a portion on the inner peripheral surface of the housing 10 of the compressor 3 that faces a side edge portion 12*a* of the blade 12. The abradable layer 20 is made of a material that is easily abraded even if the impeller 11 comes into contact with the material (hereinafter, referred to as an "abradable material"), and is formed so as to narrow a clearance gap between the housing 10 and the blade 12 of the impeller 11. The formation of the abradable layer 20 narrows the clearance gap between the housing 10 and the impeller 11. As a result, the performance of the turbocharger 1 can be enhanced, and reliability can be assured because the impeller 11 is not damaged even if the impeller 11 comes into contact with the abradable layer 20.

The abradable material is a material which is to form the abradable layer 20 when being solidified, and is synthetic resin, for example. Epoxy resin, polyamide, polyimide, and the like can be applied as synthetic resin. In addition, as the abradable material, synthetic resin may contain fine particles having a self-lubricating property that are dispersed at a content rate of 5 wt % to 50 wt %. The fine particles have a grain size of 5 μm to 50 μm, and examples of the fine particles include molybdenum disulfide, polytetrafluoroethylene (PTFE), hexagonal boron nitride (hBN), graphite, and the like.

By the fine particles having a self-lubricating property being dispersed in the abradable material, the slidability of the solidified abradable layer 20 can be assured. As a result, frictional resistance caused when the impeller 11 comes into contact with the abradable layer 20 can be reduced, and damages to the impeller 11 can be prevented.

In addition, the abradable layer 20 may have such a structure that a resin density becomes lower on a surface side of the abradable layer 20 than that on a surface adhering to the housing 10 being a base material. With this structure, the abradable layer 20 tightly adheres to the housing 10 on the surface adhering to the housing 10, whereas the strength of the abradable layer 20 becomes lower on the surface side of the abradable layer 20. Thus, the abradable layer 20 becomes easily-abradable when the impeller 11 comes into contact with the abradable layer 20, and damages to the impeller 11 can be prevented.

As a method of lowering the resin density on the surface side of the abradable layer 20, the following methods are conceivable.

(1) No air bubble is contained on the surface side adhering to the housing 10, whereas air bubbles are contained on the surface side of the abradable layer 20. A layer containing air bubbles is thereby formed on the surface side of the abradable layer 20, and the resin density on the surface side of the abradable layer 20 can be lowered.

(2) An asperity surface having a relatively-high surface roughness degree is formed on the surface of the abradable layer 20. Similarly to the case of (1), the resin density on the surface side of the abradable layer 20 can be thereby lowered.

(3) A content rate of fine particles on the surface side of the abradable layer 20 is made higher than that on the surface side adhering to the housing 10. Accordingly, a larger number of fine particles are contained on the surface side of the abradable layer 20, and the resin density on the surface side of the abradable layer 20 can be lowered. More specifically, by dispersing, in the abradable material, fine particles with a density lower than that of synthetic resin serving as a base material, the fine particles are suspended on the surface side before the abradable material is solidified, and then, the fine particles are fixed on the surface side when the abradable material is solidified. Examples of the fine particles include molybdenum disulfide, PTFE, hBN, graphite, hollow floating fine particles, and the like.

For lowering the resin density on the surface side of the abradable layer 20, the aforementioned (1) to (3) methods may be implemented using the same synthetic resin, or may be implemented as a multilayered structure including two or more layers using different types of synthetic resin or different compositions. For example, synthetic resin or a composition having high density and high adhesiveness is employed on the surface side adhering to the housing 10, whereas synthetic resin or a composition having high abradability is employed on the surface side of the abradable layer 20.

A method of applying the abradable layer 20 according to the present embodiment will be described below.

The abradable layer 20 is formed by applying coating of the abradable material only to a predetermined range on the inner peripheral surface of the housing 10, without applying masking. In addition, because this is coating application, a coating thickness can be adjusted in the application, so that post-processing or finishing for adjusting a coating thickness is not performed.

Because the coating of the abradable material is applied onto the surface of the housing 10, it is unnecessary to additionally manufacture an abradable material as a component, and to perform changeover according to the shape of the impeller 11 or the housing 10. In addition, because the coating application can be performed in the same productive facilities regardless of the shape of the impeller 11 or the housing 10, productivity is high.

In addition, unlike conventional thermal spraying and spray coating, the coating application can form the abradable layer 20 only in the predetermined range without applying masking. This can enhance productivity. Furthermore, in the coating application, adjustment of a coating thickness can be easily performed, so that the post-processing and the finishing become unnecessary. As a result, mass productivity becomes high, and the application can be performed inexpensively.

Figure 3:
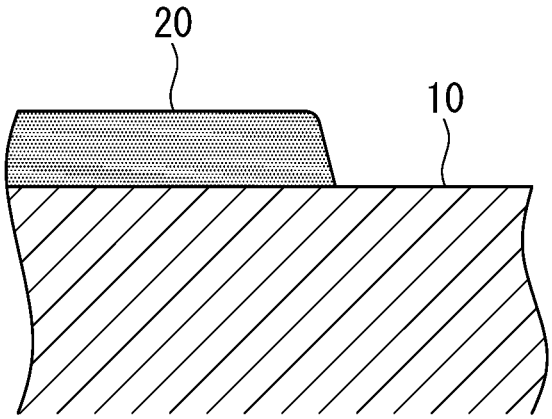
FIG. 3 is a vertical cross-sectional view illustrating an abradable layer formed on a housing inner surface of the supercharger according to the first embodiment of the present invention, and illustrates a state immediately after coating application.
Figure 4:
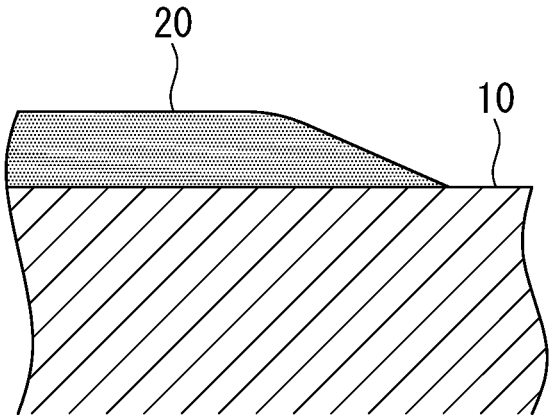
FIG. 4 is a vertical cross-sectional view illustrating the abradable layer formed on the housing inner surface of the supercharger according to the first embodiment of the present invention, and illustrates a state in which time has elapsed from the coating application.
Figure 15:
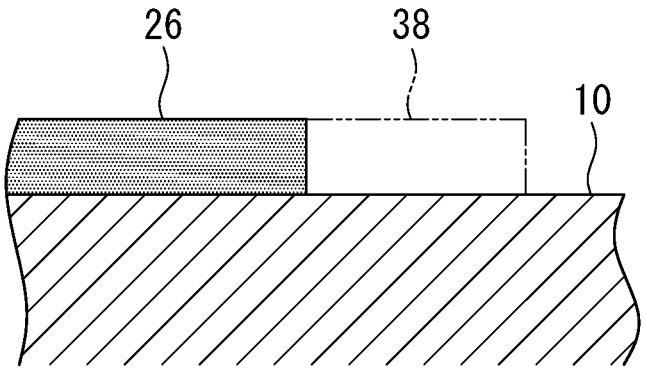
FIG. 15 is a vertical cross-sectional view illustrating an abradable layer formed on a housing inner surface of a conventional supercharger, and illustrates a state in which a masking tape is peeled off.

Furthermore, because the coating is applied without performing masking, the abradable layer 20 obtained immediately after the coating application is in a state as illustrated in FIG. 3, and the abradable material wetly spreads on the surface of the housing 10 as time elapses. When masking is applied, after the abradable material is solidified to some extent, a masking tape 38 or the like is peeled off as illustrated in FIG. 15. This generates a level difference at an end portion of an abradable layer 26. In contrast, unlike the case of applying masking, the present embodiment can cause a state in which no level difference is generated at an end portion of the abradable layer 20 as illustrated in FIG. 4. Thus, the separation of airflow on the surface of the housing 10 can be suppressed, and efficiency degradation of the supercharger can also be suppressed.

Figure 5:
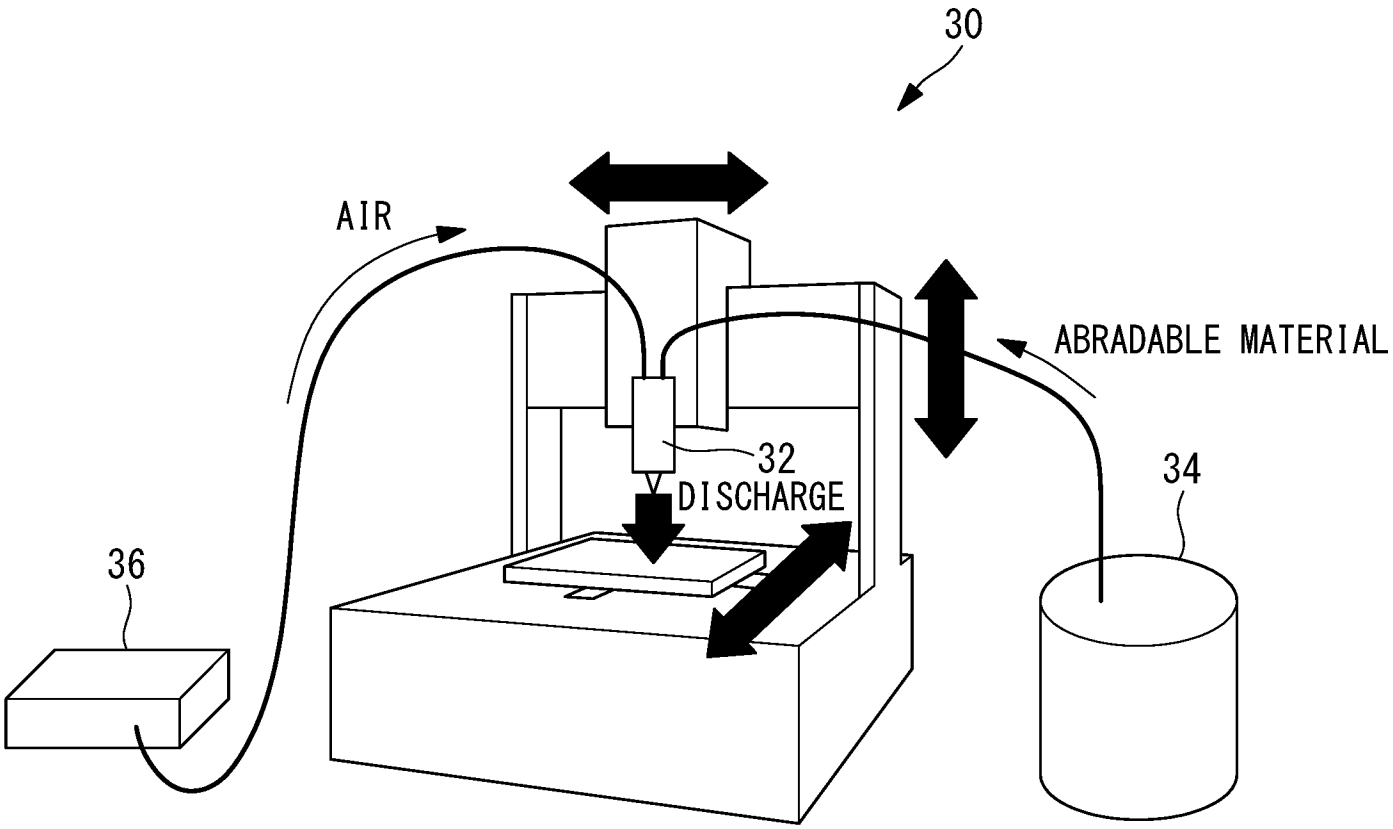
FIG. 5 is a perspective view illustrating a three-axis robot and a constant amount discharge nozzle.

As a method of applying coating of the abradable material, as illustrated in FIG. 5, there is a method of using a constant amount discharge nozzle 32 of which the position is controlled by a three-axis robot 30 in three-axis directions. In addition, the housing 10 to which the abradable material is applied is not illustrated in FIG. 5. The constant amount discharge nozzle 32 is provided in the three-axis robot 30, and the constant amount discharge nozzle 32 is supplied with the abradable material from a tank 34. An amount of the abradable material discharged from the constant amount discharge nozzle 32 is adjusted by adjusting the pressure of air supplied from a controller 36.

With this configuration, the coating of the abradable material is applied in a state in which the abradable material is brought close to the surface of the housing 10. Thus, the abradable layer 20 can be formed only in the predetermined range without applying masking. In addition, a device that performs the position control of the constant amount discharge nozzle 32 is not limited to the three-axis robot 30, and another device such as a robot that can perform position control only in two-axis directions may be used.

In addition, a tool used in the coating application performed on the surface of the housing 10 is not limited to the constant amount discharge nozzle, and a brush may be used. Also in this case, position control is performed by the three-axis robot 30 or the like. The brush is installed in place of the aforementioned constant amount discharge nozzle 32. With this configuration, the coating of the abradable material is applied in a state in which the abradable material is pressed against the surface of the housing 10. Thus, the abradable layer 20 can be formed only in the predetermined range without applying masking.

Figure 6:
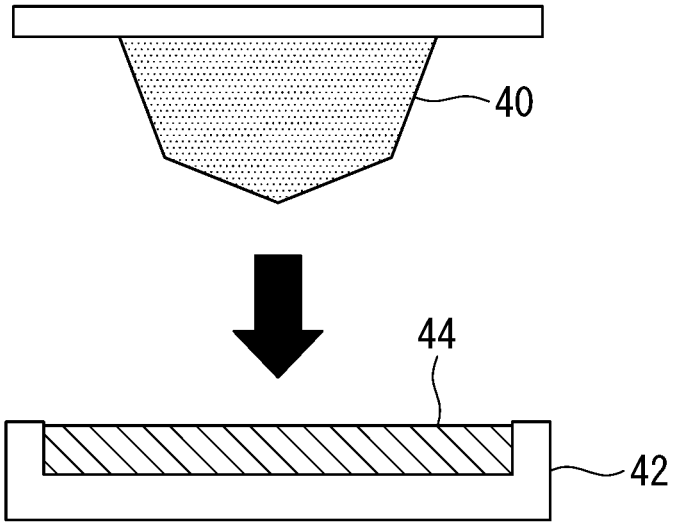
FIG. 6 is a schematic view illustrating a pad and a container in pad printing.
Figure 7:
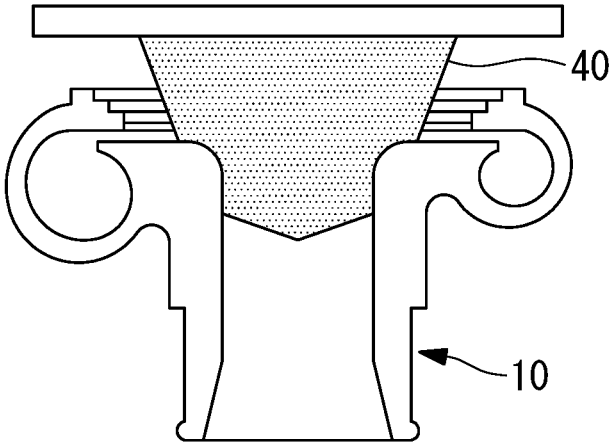
FIG. 7 is a schematic view illustrating the housing of the supercharger and the pad in the pad printing.

Furthermore, as illustrated in FIGS. 6 and 7, the coating application performed on the surface of the housing 10 may be performed by pad printing. A generally-performed method can be applied to the pad printing. More specifically, after an abradable material 44 stored in a container 42 is adhered to a silicone pad 40 as illustrated in FIG. 6, the pad 40 is brought into contact with the housing 10 as illustrated in FIG. 7. The coating of the abradable material 44 is thereby applied onto the inner surface of the housing 10. Also in this case, the coating of the abradable material is applied in a state in which the abradable material is pressed against the surface of the housing 10. Thus, the abradable layer 20 can be formed only in the predetermined range without applying masking.

Figure 8:
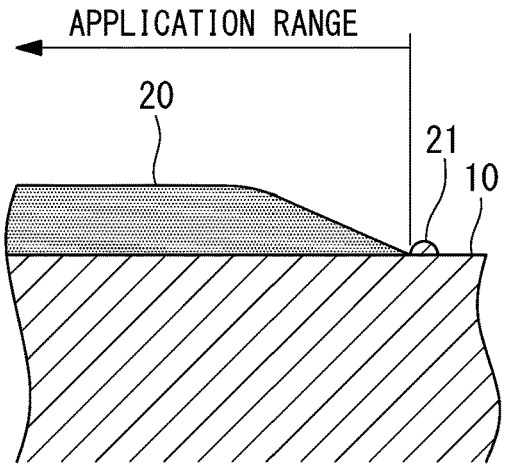
FIG. 8 is a vertical cross-sectional view illustrating the abradable layer and a protruding portion according to the first embodiment of the present invention.
Figure 9:
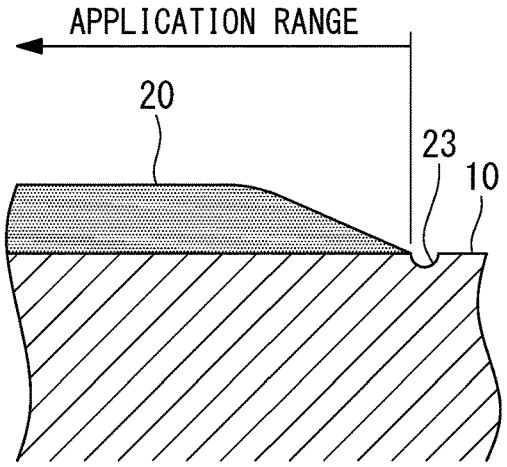
FIG. 9 is a vertical cross-sectional view illustrating the abradable layer and a recess portion according to the first embodiment of the present invention.

Before the coating of the abradable material is applied onto the surface of the housing 10, as illustrated in FIG. 8 or 9, a protrusion (protruding portion 21) or a recess (recess portion 23) may be formed on the surface of the housing 10 at a boundary of a region in which the abradable layer 20 is to be formed. By the protruding portion 21 or the recess portion 23 being formed on the surface of the housing 10, it becomes difficult for the abradable material to spread excessively, so that the abradable layer 20 is surely applied to the predetermined range. The protruding portion 21 or the recess portion 23 has such a height or a depth that a flow of air is not disturbed, and the performance of the turbocharger 1 is not affected. It is desirable that the protruding portion 21 be a minute protrusion lower than the height of the abradable layer 20.

Figure 10:
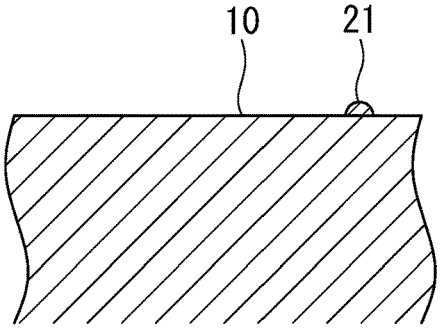
FIG. 10 is a vertical cross-sectional view illustrating a protruding portion according to the first embodiment of the present invention.

Various methods can be applied to the formation of the protruding portion 21. For example, the protruding portion 21 may be formed by coating application as illustrated in FIG. 10. In this process, by using a quick-drying material as a coating material of the protruding portion 21, the process can be promptly shifted to the application of the abradable layer 20. In addition, the same material as the abradable material may be used as the coating material of the protruding portion 21. It accordingly becomes unnecessary to prepare a material different from that used in the formation of the abradable layer 20, and compatibility in the abradable layer 20 becomes higher. This can prevent detachment and the like.

Figure 11:
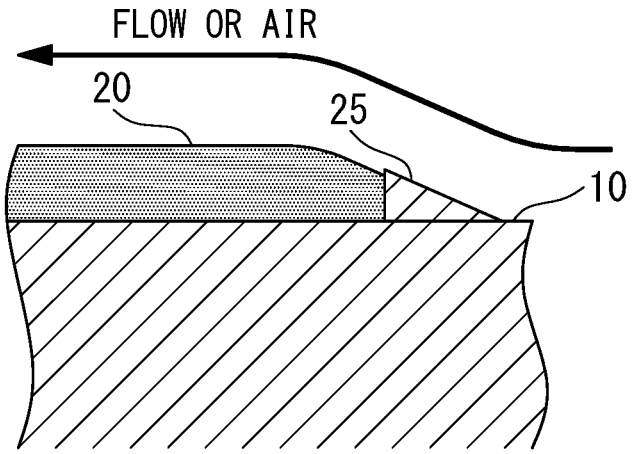
FIG. 11 is a vertical cross-sectional view illustrating the abradable layer and a protruding portion according to the first embodiment of the present invention.

As the shape of the protruding portion 21, a vertical cross-sectional shape may be a semicircular shape, or a vertical cross-sectional shape may have a gently-inclined surface as in a protruding portion 25 illustrated in FIG. 11. By forming the shape of the protruding portion 25 into a shape smoothly connected to the surface of the housing 10 on an upstream side of a flow of air on the abradable layer 20, the protruding portion 25 can be prevented from disturbing the flow of air.

Figure 12:
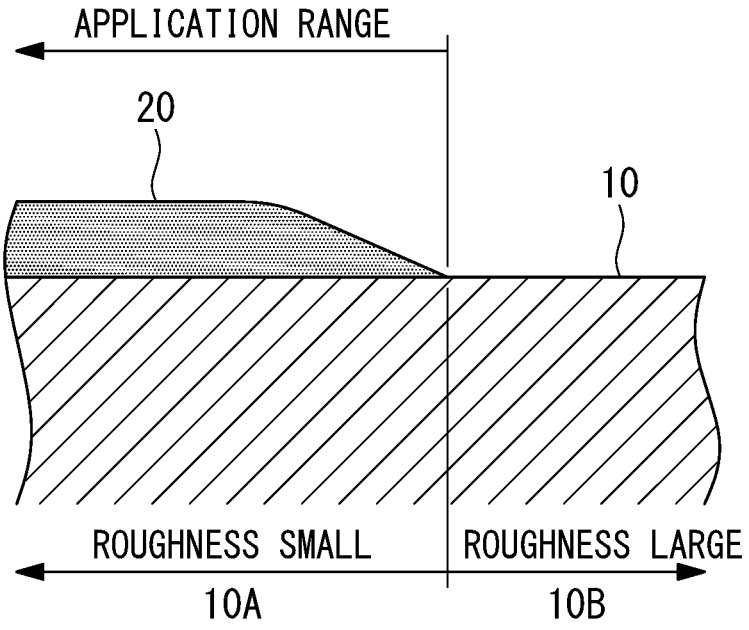
FIG. 12 is a vertical cross-sectional view illustrating the abradable layer according to the first embodiment of the present invention.

In addition, as illustrated in FIG. 12, before the coating of the abradable material is applied onto the surface of the housing 10, processing may be performed so as to roughen a roughness degree in an outside region 10B of a region 10A in which the abradable layer 20 is to be formed, to be rougher than a roughness degree in the region 10A in which the abradable layer 20 is to be formed. With this configuration, by the roughness degree getting higher in the outside region 10B of the region 10A in which the abradable layer 20 is to be formed, it becomes difficult for the abradable material to spread excessively, so that the abradable layer 20 is surely applied to the predetermined range.

Second Embodiment

Figure 13:
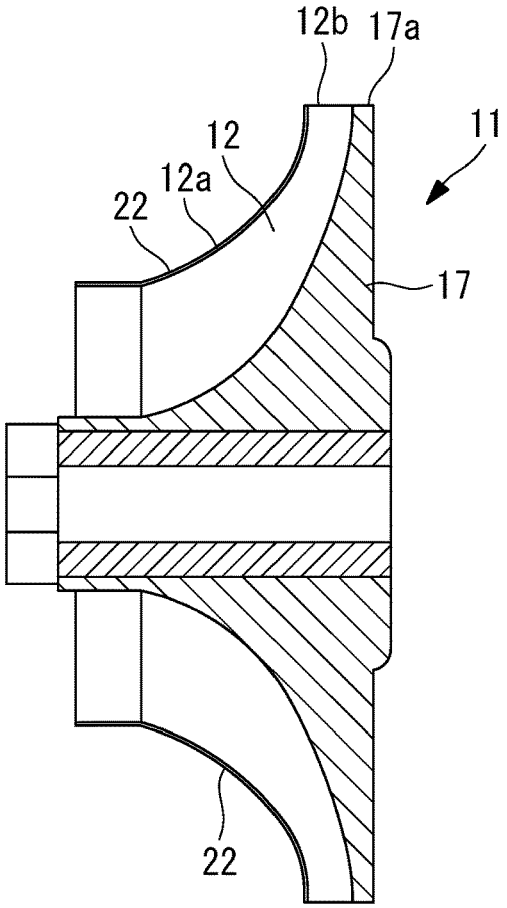
FIG. 13 is a vertical cross-sectional view illustrating an impeller of a supercharger according to a second embodiment of the present invention.

Next, a turbocharger according to a second embodiment of the present invention will be described. In the aforementioned first embodiment, the description has been given of a case in which the abradable layer 20 is formed in the predetermined range on the inner peripheral surface of the housing 10 of the compressor 3. Nevertheless, the present invention is not limited to this example. In the present embodiment, as illustrated in FIG. 13, an abradable layer 22 is formed in a side edge portion 12*a* of a blade 12 of an impeller 11 of a compressor 3.

In the following description, the detailed descriptions of components described in the first embodiment will be omitted.

In the present embodiment, the abradable layer 22 is formed in the side edge portion 12*a* of the blade 12, which is a portion facing the inner peripheral surface of a housing 10 of the compressor 3.

The abradable layer 22 is made of an abradable material similar to that in the first embodiment, and is formed so as to narrow a clearance gap between the housing 10 and the blade 12 of the impeller 11. The formation of the abradable layer 22 narrows the clearance gap between the housing 10 and the impeller 11. As a result, the performance of a turbocharger 1 can be enhanced, and reliability can be assured because the impeller 11 is not damaged even if the impeller 11 comes into contact with the abradable layer 22.

The abradable layer 22 is formed by applying coating of the abradable material only to a predetermined range at a tip of the blade 12. When the coating of the abradable material is solidified, the abradable layer 22 is formed in the predetermined range. In addition, because this is coating application, a coating thickness can be adjusted in the application, so that post-processing or finishing for adjusting a coating thickness is not performed.

As a method of applying coating of the abradable material, similarly to the first embodiment, there are a method of using a constant amount discharge nozzle or a brush of which the position is controlled by a three-axis robot 30 in three-axis directions, and a method of using pad printing. In addition, a method of applying the abradable material is not limited to the coating application, and the abradable material may be applied by spray coating. Nevertheless, in this case, masking is performed on the outside of the predetermined range so that the abradable material is applied to the predetermined range.

An area in which the abradable material is applied to the side edge portion 12*a* of the blade 12 of the impeller 11 is smaller than an area in which the abradable material is applied to the inner peripheral surface of the housing 10. Thus, by applying the abradable material not to the housing 10 but to the impeller 11, a used amount of the abradable material can be reduced to a small amount, and the application of the abradable material becomes inexpensive. In addition, a volume of the impeller 11 is smaller than that of the housing 10. Thus, when synthetic resin of the abradable material is thermoset resin, and rises in temperature when being cured, a temperature rise speed of the impeller 11 becomes higher than that of the housing 10. This can shorten an application time, and can reduce facility costs.

Third Embodiment

Figure 14:
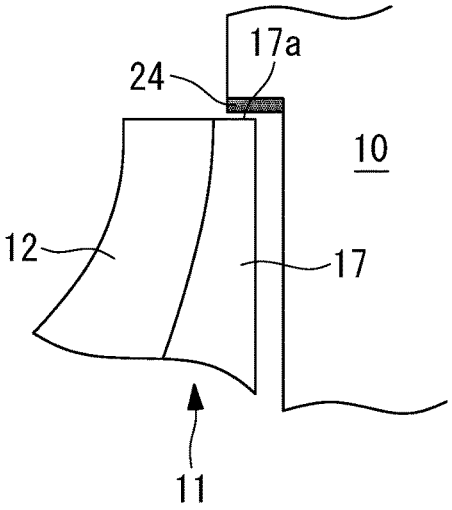
FIG. 14 is a partially-enlarged vertical cross-sectional view illustrating an impeller and a housing of a supercharger according to a third embodiment of the present invention.

Next, a turbocharger according to a third embodiment of the present invention will be described. In the aforementioned first embodiment, the description has been given of a case in which the abradable layer 20 is formed on a surface facing the blade 12, in the inner peripheral surface of the housing 10 of the compressor 3. Nevertheless, the present invention is not limited to this example. In the present embodiment, as illustrated in FIG. 14, an abradable layer 24 is formed on a surface facing an outer peripheral surface 17*a* of an end plate 17 of an impeller 11, in the inner peripheral surface of a housing 10 of a compressor 3.

In the following description, the detailed descriptions of components described in the first embodiment will be omitted.

In the present embodiment, the abradable layer 24 is formed on a surface, which is the inner peripheral surface of the housing 10 of the compressor 3, and is a surface facing the outer peripheral surface 17*a* of the end plate 17 of the impeller 11.

The abradable layer 24 is made of an abradable material similar to that in the first embodiment, and is formed so as to narrow a clearance gap between the housing 10 and the end plate 17 of the impeller 11. The formation of the abradable layer 24 narrows the clearance gap between the housing 10 and the end plate 17 of the impeller 11. As a result, the performance of a turbocharger 1 can be enhanced, and reliability can be assured because the impeller 11 is not damaged even if the impeller 11 comes into contact with the abradable layer 24.

The abradable layer 24 is formed by applying coating of the abradable material only to a predetermined range on the surface facing the outer peripheral surface 17*a* of the end plate 17 of the impeller 11, in the inner peripheral surface of the housing 10. When the coating of the abradable material is solidified, the abradable layer 24 is formed in the predetermined range. In addition, because this is coating application, a coating thickness can be adjusted in the application, so that post-processing or finishing for adjusting a coating thickness is not performed.

As a method of applying the coating of the abradable material, similarly to the first embodiment, there are a method of using a constant amount discharge nozzle or a brush of which the position is controlled by a three-axis robot 30 in three-axis directions, and a method of using pad printing. In addition, a method of applying the abradable material is not limited to the coating application, and the abradable material may be applied by spray coating. Nevertheless, in this case, masking is performed on the outside of the predetermined range so that the abradable material is applied to the predetermined range.

An area in which the abradable material is applied to the surface facing the outer peripheral surface 17*a* of the end plate 17 of the impeller 11, in the inner peripheral surface of the housing 10 is smaller than an area in which the abradable material is applied to the surface facing the blade 12, in the inner peripheral surface of the housing 10. Thus, by applying the abradable material to the surface facing the outer peripheral surface 17*a* of the end plate 17 of the impeller 11, a used amount of the abradable material can be reduced to a small amount, and the application of the abradable material becomes inexpensive.

In addition, in the aforementioned embodiment, the description has been given of a case in which the abradable material is applied to the surface facing the outer peripheral surface 17*a* of the end plate 17 of the impeller 11, in the inner peripheral surface of the housing 10. Nevertheless, the present invention is not limited to this example. More specifically, when the impeller 11 and a bearing housing 15 face each other, an abradable layer may be formed on a surface facing the outer peripheral surface 17*a* of the end plate 17 of the impeller 11, not in the inner peripheral surface of the housing 10 but in the inner peripheral surface of the bearing housing 15.

In addition, an abradable layer may be formed not on the inner peripheral surface side of the housing 10 or the bearing housing 15, but on the outer peripheral surface 17*a* of the end plate 17 of the impeller 11.

Also in these cases, a clearance gap between the housing 10 and the end plate 17 of the impeller 11 becomes narrower. As a result, the performance of the turbocharger 1 can be enhanced, and reliability can be assured because the impeller 11 is not damaged even if the impeller 11 comes into contact with the abradable layer.

REFERENCE SIGNS LIST

1 turbocharger
2 turbine
3 compressor
4 rotation shaft
5 housing
6 impeller
7 blade
8 scroll passage
9 discharge port
10 housing
11 impeller
12 blade
13 suction port
14 compressor passage
15 bearing housing (housing)
16 bearing
17 end plate
20, 22, 24 abradable layer

The invention claimed is:

1. A method of manufacturing a supercharger including a turbine configured to rotationally drive, and a compressor having an impeller configured to rotate according to rotational force of the turbine and a housing configured to store the impeller, the method comprising: a process of applying coating of an abradable material which is to form an abradable layer when being solidified, only to a predetermined range on either one of surfaces of the impeller and the housing via which the impeller and the housing face; and before the process of applying coating of the abradable material, a process of forming a recess portion to separate either one of the surfaces of the impeller and the housing into the predetermined range and an outer range to which coating of the abradable material is not applied, the recess portion being directly adjacent to each of the outer range and the predetermined range, wherein either one of the surfaces is a smoothly continuous surface before the recess portion is formed.

2. A method of manufacturing a supercharger including a turbine configured to rotationally drive, and a compressor having an impeller configured to rotate according to rotational force of the turbine and a housing configured to store the impeller, the method comprising: a process of applying coating of an abradable material which is to form an abradable layer when being solidified, only to a predetermined range on a surface, the surface being either one of surfaces of the impeller and the housing via which the impeller and the housing face; and before the process of applying coating of the abradable material, a process of increasing a roughness degree in an outer range to which coating of the abradable material is not applied, the outer range being directly adjacent to the predetermined range, to be rougher than a roughness degree in the predetermined range, on either one of the surfaces of the impeller and the housing, wherein a region to which coating of the abradable material is applied and a region to which coating of the abradable material is not applied are on the same continuous surface.

3. A method of manufacturing a supercharger including a turbine configured to rotationally drive, and a compressor having an impeller configured to rotate according to rotational force of the turbine and a housing configured to store the impeller, the method comprising: a process of applying coating of an abradable material which is to form an abradable layer when being solidified, only to a predetermined range on either one of surfaces of the impeller and the housing via which the impeller and the housing face, without applying masking, and before the process of applying coating of the abradable material, a process of forming a recess portion to separate either one of the surfaces of the impeller and the housing into the predetermined range and an outer range to which coating of the abradable material is not applied, the recess portion being directly adjacent to each of the outer range and the predetermined range, wherein either one of the surfaces is a smoothly continuous surface before the recess portion is formed.

4. The method of manufacturing a supercharger according to claim 3, wherein coating of the abradable material is applied using a brush or a pad.

5. The method of manufacturing a supercharger according to claim 3, further comprising a process of increasing a roughness degree in the outer range to which coating of the abradable material is not applied, the outer range being adjacent to the predetermined range, to be rougher than a roughness degree in predetermined range, on either one of the surfaces of the impeller and the housing, before the process of applying coating of the abradable material.

6. The method of manufacturing a supercharger according to claim 3, wherein the abradable material contains synthetic resin and fine particles having a self-lubricating property.

7. The method of manufacturing a supercharger according to claim 3, wherein coating of the abradable material is applied so that a density becomes lower on a surface side of the abradable layer than a density on a side of the impeller or a side of the housing, when the abradable material is solidified.

* * * * *